US005320387A

United States Patent [19]

Carlson

[11] Patent Number: 5,320,387

[45] Date of Patent: Jun. 14, 1994

[54] PRINTABLE COPLANAR LAMINATES AND METHOD OF MAKING SAME

[75] Inventor: Thomas S. Carlson, 19 Mid Oaks Rd., St. Paul, Minn. 55113

[73] Assignee: Thomas S. Carlson, St. Paul, Minn.

[21] Appl. No.: 852,562

[22] Filed: Mar. 17, 1992

Related U.S. Application Data

[63] Continuation-in-part of PCT/US91/06803, Sep. 19, 1991 which is a continuation-in-part of Ser. No. 632,316, Dec. 21, 1990, Pat. No. 5,131,686, which is a continuation-in-part of Ser. No. 585,614, Sep. 20, 1990, Pat. No. 5,096,229.

[51] Int. Cl.[5] ..... B42D 15/00

[52] U.S. Cl. ..... 283/75; 283/67; 283/107

[58] Field of Search ..... 283/67, 70, 75, 74, 283/85, 86, 107, 108, 109, 110

[56] References Cited

U.S. PATENT DOCUMENTS

| | | | |
|---|---|---|---|
| 1,089,486 | 3/1914 | Levine | 283/116 X |
| 1,114,920 | 10/1914 | Seeligson | 283/116 X |
| 1,436,885 | 11/1922 | Leary | 283/116 X |
| 4,447,481 | 5/1984 | Holmberg et al. . | |
| 4,525,116 | 6/1985 | Holmberg . | |
| 4,536,013 | 8/1985 | Haghiri-Therani et al. . | |
| 4,589,687 | 5/1986 | Hannon . | |
| 4,590,109 | 5/1986 | Holmberg . | |
| 4,618,520 | 10/1986 | Holmberg . | |
| 4,732,410 | 3/1988 | Holbein et al. . | |
| 4,747,620 | 5/1988 | Kay et al. . | |
| 4,748,452 | 5/1988 | Maurer . | |
| 4,765,653 | 8/1988 | Fasham et al. | 283/116 X |
| 4,780,974 | 11/1988 | Mitchell . | |
| 4,817,310 | 4/1989 | Breen et al. . | |
| 4,865,669 | 9/1989 | Schmidt . | |
| 4,923,112 | 5/1990 | Dale et al. . | |
| 4,936,608 | 6/1990 | Gensel et al. . | |
| 4,951,864 | 8/1990 | Dicker . | |
| 4,955,640 | 9/1990 | Anderson . | |
| 5,005,872 | 4/1991 | Lass et al. . | |
| 5,096,229 | 3/1992 | Carlson | 283/67 X |
| 5,131,686 | 7/1992 | Carlson | 283/75 |

FOREIGN PATENT DOCUMENTS

| | | |
|---|---|---|
| 0047182 | 2/1981 | European Pat. Off. . |
| 2226297A | 6/1990 | United Kingdom . |

OTHER PUBLICATIONS

Abstract of U.S. Pat. 1o. 3,319,872 to Beckman, issued May 16, 1967.

Abstract of U.S. Pat. No. 3,273,785 to Beckman, issued Sep. 20, 1966.

*Primary Examiner*—Mark Rosenbaum
*Assistant Examiner*—Willmon Fridie, Jr.
*Attorney, Agent, or Firm*—Vidas, Arrett & Steinkraus

[57] ABSTRACT

A sheetstock for preparing business forms including printable solid plastic identification cards and labels is formed from a single coplanar sheet. Return envelope mailers which may be imprinted with various types of computerized imaging equipment are defined on a single sheet that is coplanar and includes only two glue lines.

8 Claims, 6 Drawing Sheets

PRINTABLE COPLANAR LAMINATES AND METHOD OF MAKING SAME

CROSS-REFERENCE TO RELATED APPLICATIONS

This application is a Continuation-in-part of PCT application serial number PCT/US91/06803 designating the United States filed Sep. 19, 1991, by the inventor under "Printable Coplanar Laminates and Method of Making Same." That application is a Continuation-in-part of application Ser. No. 07/632,316 Dec. 21, 1990, now U.S. Pat. No. 5,131,686 which is in turn a Continuation-in-part of application Ser. No. 07/585,614 filed Sep. 20, 1990, now U.S. Pat. No. 5,096,229 by the inventor under "Method for Producing Identification Cards." Each of these applications are incorporated herein by reference.

BACKGROUND OF THE INVENTION

1. Field of the Invention

This invention relates to paper and plastic constructions useful in forming plastic identification cards, labels, and return envelope mailers imprintable with various types of printing and computerized imaging methods.

2. Description of the Related Art

Prior inventions by the applicant did not provide solid plastic cards. In addition, some of the prior forms and cards also had die-cut ties holding the cards to the form creating nubs on the plastic cards after they have been removed which may not be aesthetically pleasing.

The return envelope of the prior application is structurally acceptable. However, two sheets of paper were needed to form it. Some additional benefits may be obtained by forming the envelope out of one sheet.

The labels of this invention use a different construction to form them which may be less expensive and easier to process.

SUMMARY OF THE INVENTION

The inventor's solution is to provide some of the same advantages as previous coplanar or functionally equivalent thickness constructions for processing various forms in printers and inserters by providing alternative constructions and providing separation means for removing desired portions of the sheetstock for various applications.

The invention offers additional ways to yield a solid plastic identification card and tags that may have holes cut through them which has a coplanar profile to the sheet it is affixed to.

The invention also offers a return envelope construction made from one sheet of paper instead of two separate sheets of paper and may have only two glue lines instead of three.

The labels offer a construction similar to previous constructions described by the inventor in copending cases that allows for more commerically available materials to be processed and embedded into the base sheet of paper.

BRIEF DESCRIPTION OF THE DRAWINGS

A detailed description of the invention is hereafter described with specific reference being made to the drawings in which:

FIG. 13 shows side view of a page of sheetstock plow folded on top of itself to form a pouch which creates a one piece return envelope mailer with holes to create windows for data to show through;

FIG. 14 shows a top view, with parts cutaway of FIG. 13 of a page of sheetstock plow folded to form a return envelope mailer with holes for data to show through;

FIG. 15 shows a bottom view of FIG. 13 of a page of sheetstock plow folded to form a return envelope mailer with holes for data to show through;

Description of the Preferred Embodiments

EXAMPLE 1

Figure 1:
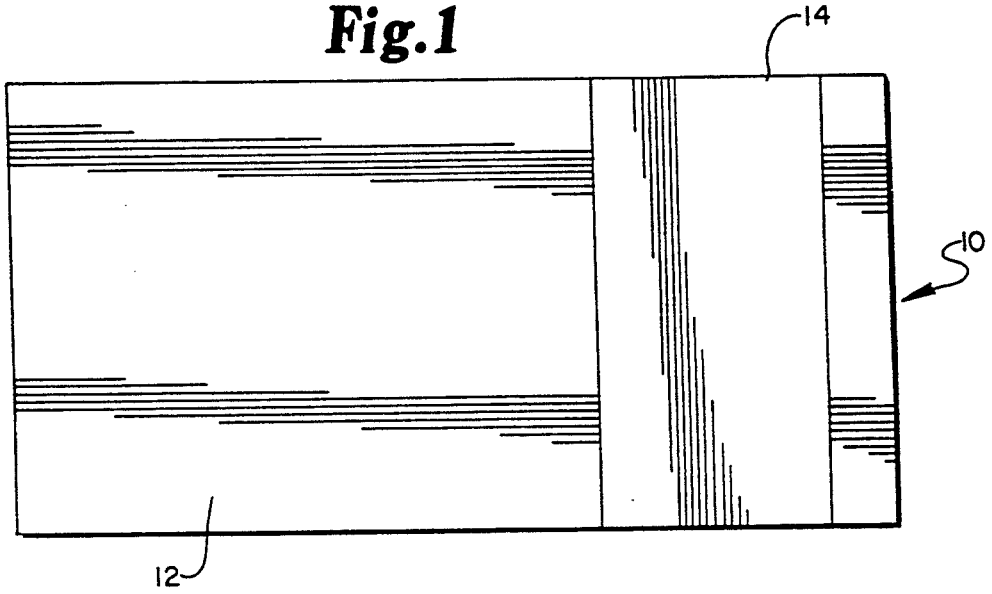
FIG. 1 is a bottom view of a page of sheetstock showing a paper or plastic laminate patch embedded into it.
Figure 2:
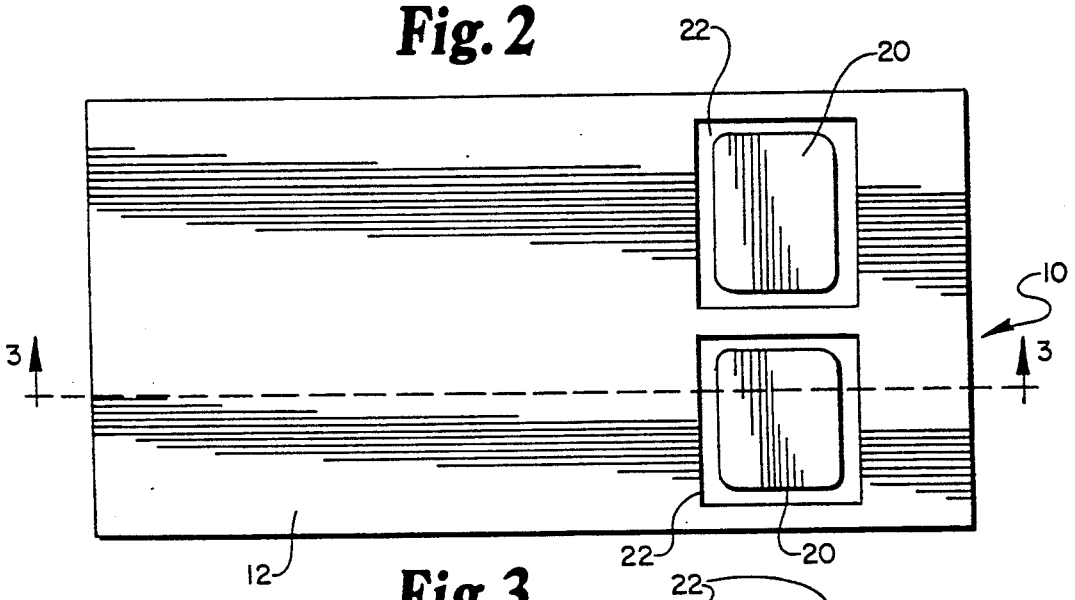
FIG. 2 is a top view of a page of sheetstock showing a hole cut through it with plastic identification cards affixed to the patch covering the hole.
Figure 3:
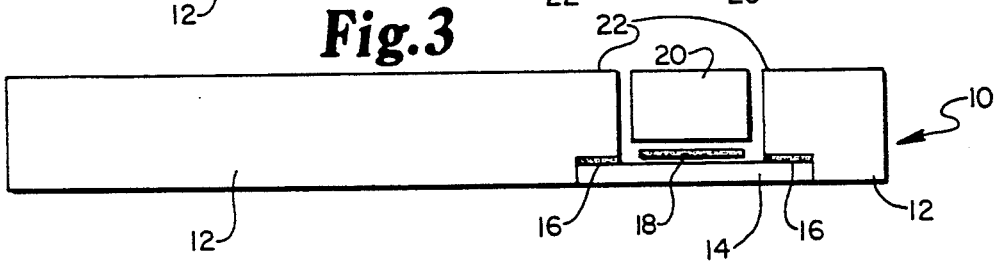
FIG. 3 is a side view of page of sheetstock showing a paper or plastic patch embedded into and adhered to the sheetstock and paper or plastic cards affixed to the patch with removable adhesive.

With reference to the FIGS. 1 through 3 it will be seen that sheetstock 10 is formed from paper or plastic 12 which has at least one hole 22 cut through it and a paper or plastic layer 14 to form a patch embedded and adhered with adhesive 16 into paper or plastic 12 so that the sheet stock is coplanar and of functionally equivalent thickness. Plastic or paper layer 14 is made from thin paper or plastic commonly available including glassine and polyesters. Adhesive 18 adheres the plastic identification card 20 to the patch 14. Adhesive 18 should hold the card in place during manufacture, laser printing and inserting but allow separation from the sheetstock by persons wanting use of the card. Such adhesives are commercially available. A release layer may also be added in conjunction with an adhesive to allow easy removal of the card from the sheetstock.

EXAMPLE 2

Figure 4:
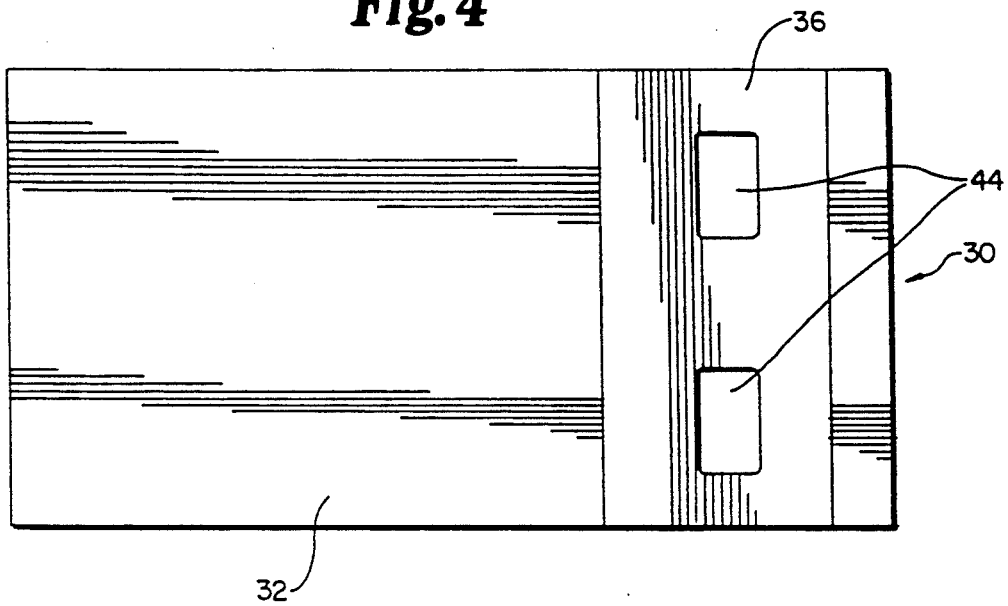
FIG. 4 is a bottom view of a page of sheetstock showing a paper or plastic laminate patch embedded into it with a hole cut in the patch being of smaller size than the plastic identification card to be adhered to it.
Figure 5:
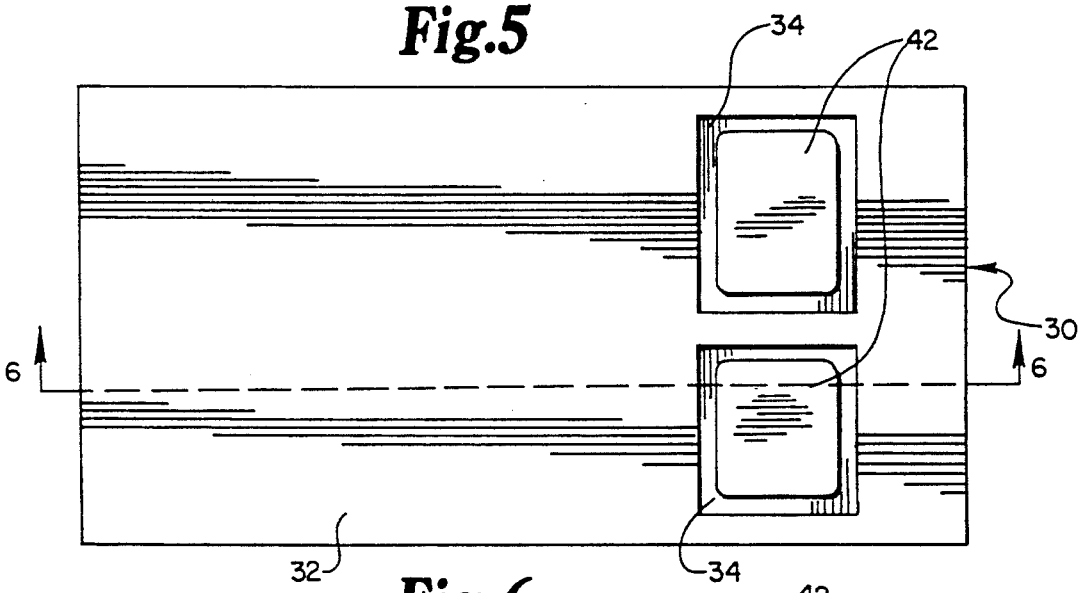
FIG. 5 is a top view of a page of sheetstock showing a hole cut through it with plastic identification cards affixed to the patch covering the hole.
Figure 6:
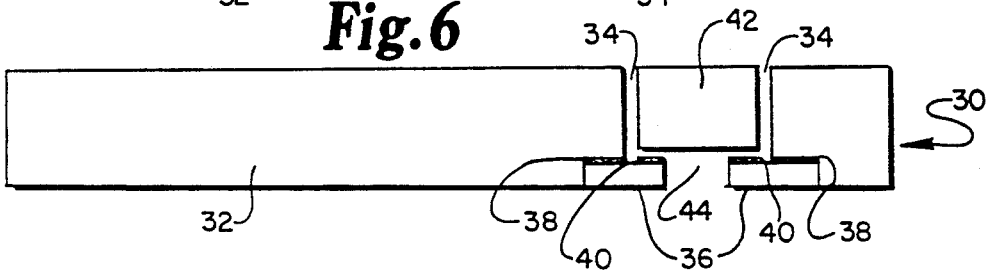
FIG. 6 is a side view of the sheetstock of FIG. 5.

With reference to FIGS. 4 through 6 it will be seen that sheetstock 30 is formed from paper or plastic 32 which has at least one hole 34 cut through it and a paper or plastic layer 36 to form a patch embedded and adhered with adhesive 38 into paper or plastic 32 so that the sheet stock is coplanar and of functionally equivalent thickness. Plastic or paper layer 36 is made from thin paper or plastic commonly available including Glassine and polyesters. Adhesive 40 adheres the plastic identification card 42 to the patch 36. This design is different from FIGS. 1-3 in that hole 44 is cut through patch 36 in such a way that the hole allows various printers to image on the back side of the identification card 42. This hole is cut in such a way so that there is sufficient space provided for the card and the hole to overlap and have adhesive to be placed on the edge of the patch 36 hole and on the border edge of the card 42. A silicone release layer may also be added in conjunction with an adhesive to allow easy removal of the card from the sheetstock.

EXAMPLE 3

Figure 7:
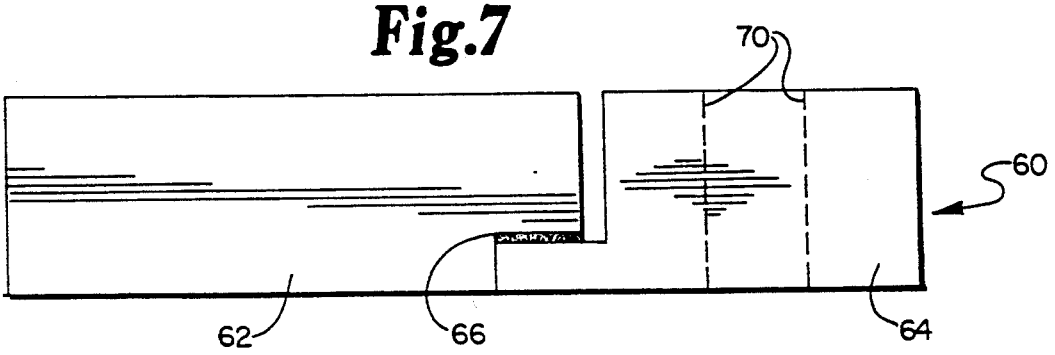
FIG. 7 is a side view of a page of sheetstock showing a die cut and notched paper or plastic portion affixed to a notched or indented paper or plastic portion and adhered into each other in the center.
Figure 8:
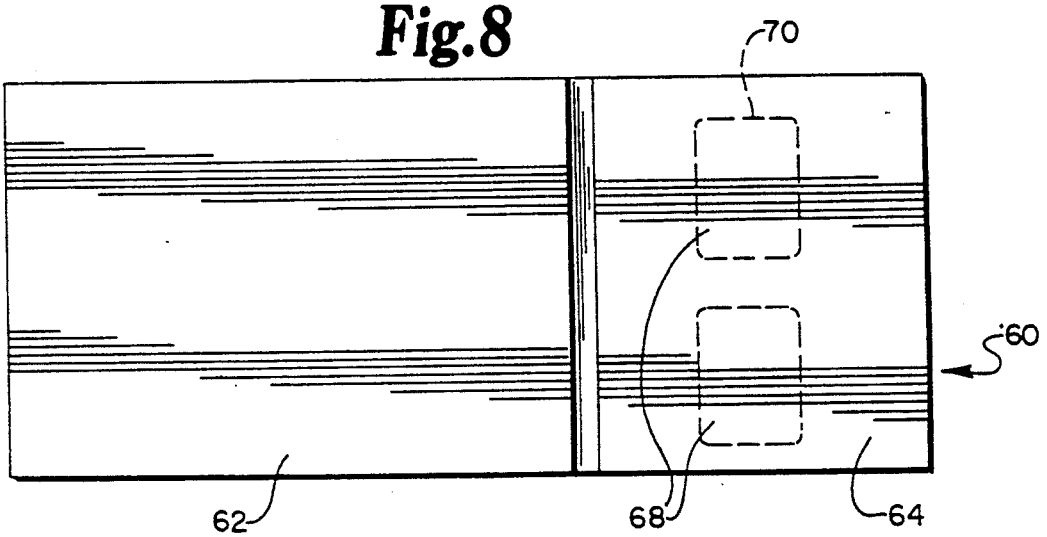
FIG. 8 is a top view of FIG. 7 showing the base page and the affixed plastic or paper portion die cut in the shape of a card.
Figure 9:
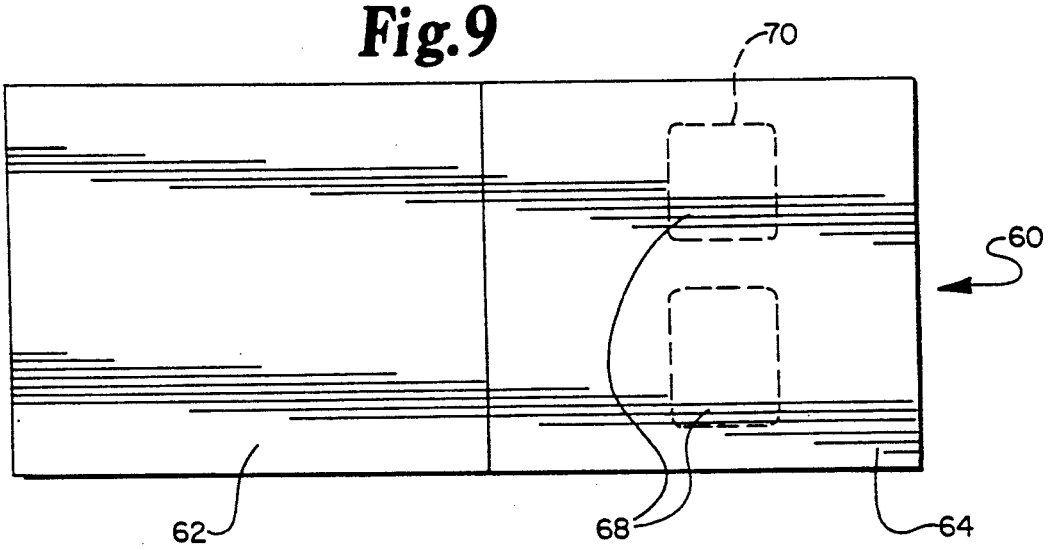
FIG. 9 is a bottom view of FIG. 7 showing the base page and the affixed plastic or paper portion and the die cuts in the shape of a card.

With reference to FIGS. 7 through 9 it will be seen that sheetstock 60 is formed from paper or plastic 62 adhered to paper or plastic 64 at a notched location with adhesive 66. Cards 68 are formed when paper or plastic 64 is die-cut with a series of closely spaced perforations 70. The plastic cards 68 are removed from the sheetstock 60 by exerting pressure to the cards to break the series of cuts and ties creating the perforations. If 64 is plastic, solid plastic identification cards (ID cards) 68 are formed and presented on a single, coplanar sheet that feeds readily through printers.

EXAMPLE 4

Figure 10:
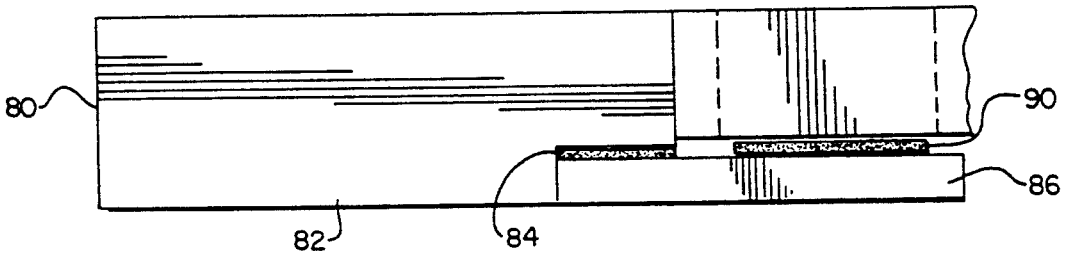
FIG. 10 is a side view of a page of sheetstock showing a carrier sheet with plastic identification cards or labels adhered to it and embedded into the edge of a core sheet to the carrier sheet portion not embedded into the core sheet.
Figure 11:
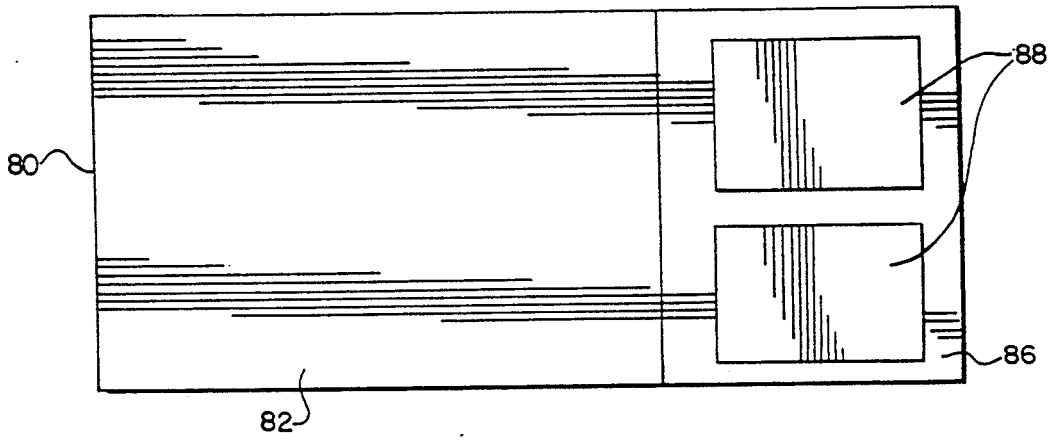
FIG. 11 is a top view of a page of FIG. 10 showing plastic identification cards or labels adhered to the carrier sheet.
Figure 12:
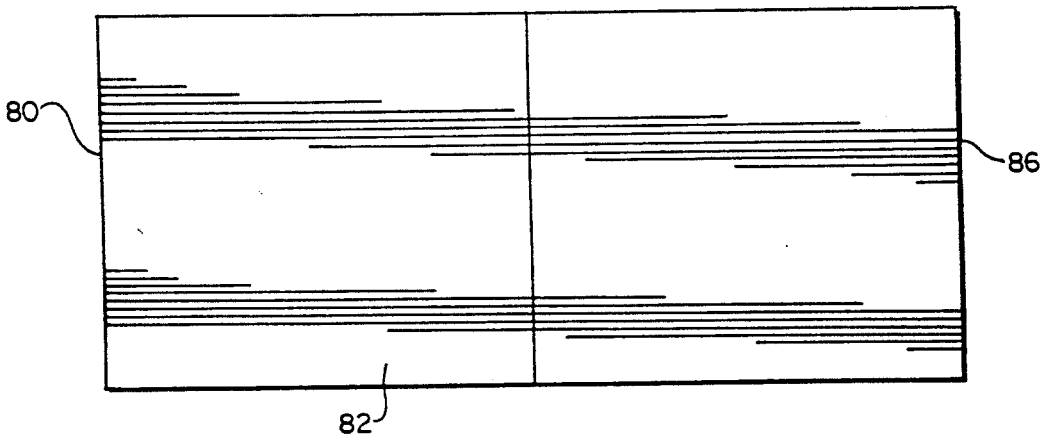
FIG. 12 show a bottom view of FIG. 10 showing the position of the base sheet and carrier sheet that is adhered to it.

With reference to FIGS. 10 through 12 it will be seen that sheetstock 80 is formed from paper or plastic 82 which is adhered by adhesive 84 to a paper or plastic card carrier 86 to which plastic cards 88 are adhered with removable adhesive 90. In addition to tipped-on plastic identification cards, the cards may be formed by having a continuous plastic laminate which is kiss cut or die cut through to 86. The balance of the matrix material may be removed or left on the sheetstock depending upon the application and desires. A combination of release liners and adhesives may also be used to allow the cards to be attached during manufacturing and processing but removed by the end recipient.

EXAMPLE 5

Figure 13:
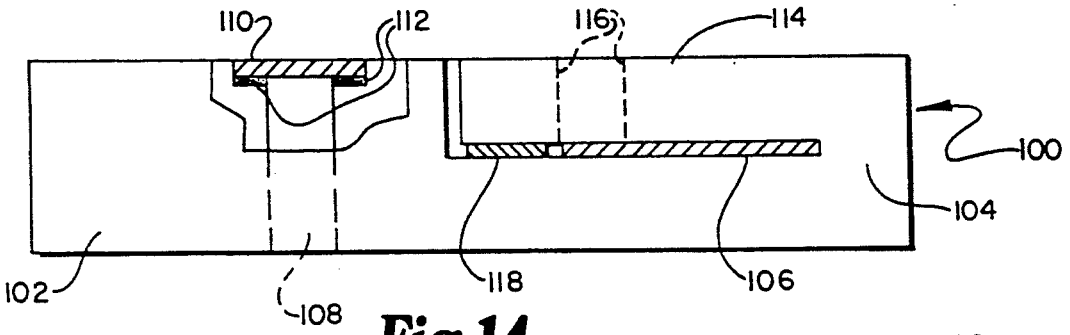
Figure 14:
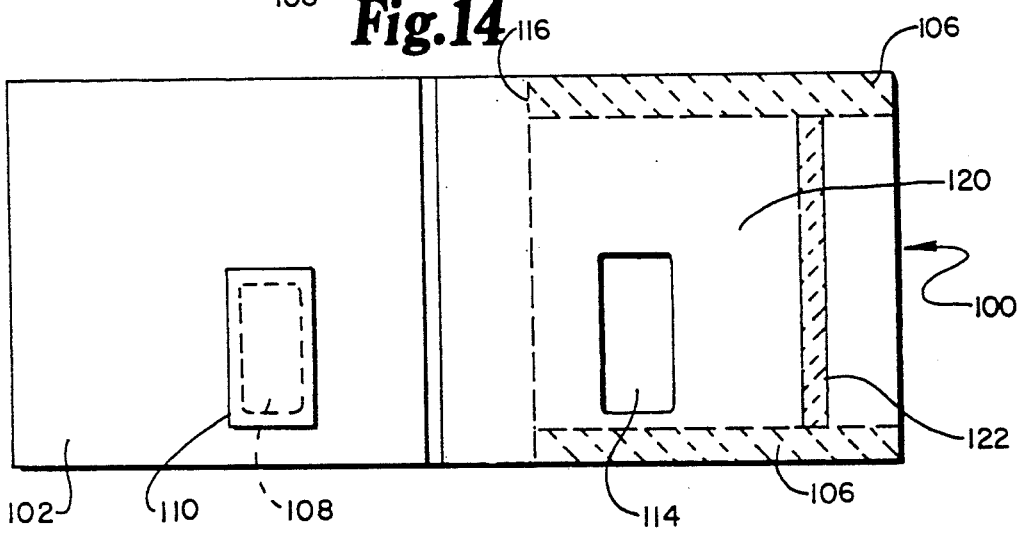
Figure 15:
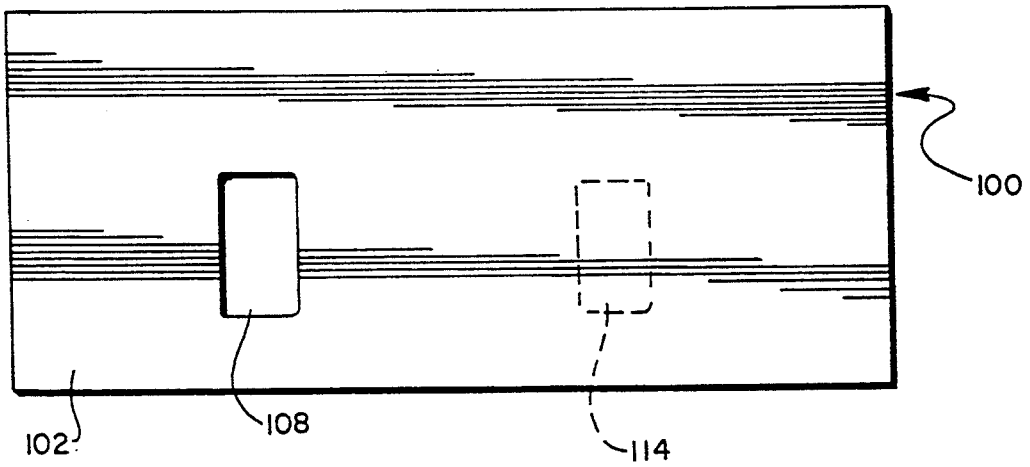

With reference to FIGS. 13 through 15 it will be seen that sheetstock 100 is formed from paper (or plastic) 102 which is bent and folded on top of itself on one end in a U shape as shown in area 104 to form one side of a three sided pouch 120*. The sheet is adhered to itself on two sides by adhesive 106 to form a pouch 120 which creates a return envelope mailer. Holes 108 may be cut through the paper 102 to allow data to be read through the mailer. A transparent paper or plastic patch 110 may be embedded into the paper 102 surrounding the hole to keep the sheetstock coplanar. The patch is affixed by adhesive 112 to paper 102. The patch material can be on either side of the paper 102. Additional holes 114 may be cut in other areas of 102 including either side of the return envelope area as shown and optionally indented and patched (not shown). Perforation 116 may be added to enhance the folding of the return flap of the return envelope portion. Adhesive 118 may be added to the flap, the side opposite the flap or simply on the base sheetstock 102 and the flap which may protect the laser printer from the contamination. The adhesive may also remain uncovered by paper or from the laser printers (not shown) if the proper adhesive is used. These adhesives allow for sticking of the flap to seal the envelope after the form has been detached from the sheetstock. Additional perforations (not shown) can be placed in the sheetstock to aid tearing a portion of the form to the size desired as for remittance. A reinforcing adhesive line 122 as shown in FIG. 14 may be added to ensure closure of the pocket. This may be useful if the plow fold area 104 is brittle and cracks or tears open.

EXAMPLE 6

Figure 16:
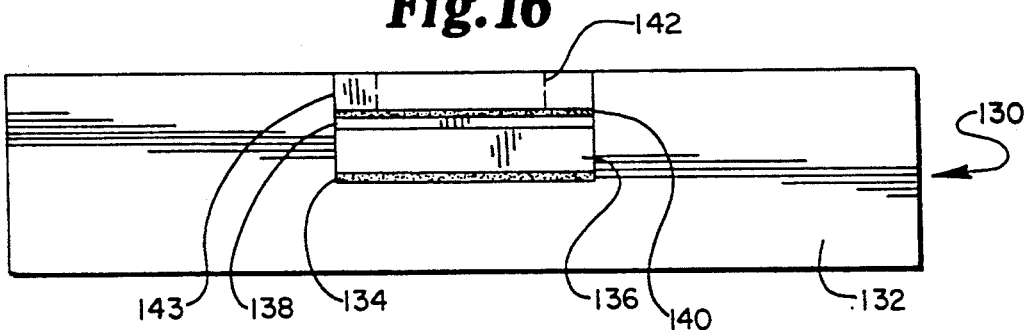
FIG. 16 shows a side view of a label construction in which the label may be solid plastic.

With reference to FIG. 16 it will be seen that sheetstock 130 is formed by compressing traditional pressure sensitive label constructions of paper or plastic liner materials, release liners, adhesives, and label stock into paper 132 which is adhered to the layers by adhesive 134. The adhesive 134 secures liner 136 to paper 130. As is common in the label industry, the liner is coated with a release coating 138 which facilitates the release of pressure sensitive adhesive 140 to stay with paper or plastic label stock 143 which may be peeled away and adhered to other materials. The label stock 143 optionally has die-cuts or kiss cuts 142 cut through it to form that shape of the label desired.

Plastic Identification Cards

A first method to form identification cards, as shown in FIGS. 1-3, is to take a base sheetstock of paper, cut a hole in it slightly larger than or about the size of the plastic card desired, compress a patch of paper or plastic into the paper on one side of the base sheetstock so that it is coplanar and is functionally equivalent in thickness to the base sheetstock and covers all of the hole or is even indented into the paper less than coplanar to the base sheetstock. On the side of the patch in which the base sheetstock hole has been cut releasable adhesive will hold a plastic, and optionally imprintable paper, plastic or combination paper and plastic identification card to the patch. The thickness of the patch, adhesive, and plastic card should be coplanar and have a functionally equivalent thickness to the base sheetstock of paper. This construction offers imaging on only one side of the plastic identification card as the patch is on the other side of the card. The card portion could also have a hole through it to make it acceptable as a tag (not shown).

A second option, as shown in FIGS. 4-6, is to modify the first method to allow imaging on two sides of the plastic card. This is done by cutting a hole in the paper or plastic patch slightly smaller than the plastic identification card(s) and applying adhesives to the edge of the hole in the patch to allow the plastic card to stick to the patch and also create a hole and thus allow the toners or inks to come in contact with the area on the card not covered by the patch. Even though the patch prevents the plastic identification card from being coplanar with the base sheetstock the patch could be made of thin enough material such as a 48 gauge or less plastic to allow the pressure exerted by the fusing mechanism in the imaging equipment to overcome the additional thickness of the paper or plastic patch and allow imaging. The hole may also allow ink jet printers to do the same. The card portion could also have a hole through it to make it usable as a tag (not shown).

A third option, as shown in FIGS. 6–8 compresses paper or plastic laminate (to provide a card carrier portion) into one of the base sheetstock's edges so that a portion of the carrier is exposed on the side of one edge of the base sheet. This exposed portion should have a release liner in combination with an adhesive or a releasable adhesive adhering the card to allow a plastic identification card to remain in place until the card is to be separated manually from the card carrier. The overall thickness of the plastic identification card, the card carrier portion and the adhesive and or release liners should be coplanar or of functionally equivalent thickness to the paper base sheetstock. The card portion could also have a hole through it to make it acceptable as a tag (not shown).

A fourth option would be to notch the edge of printable plastic by either routing or compressing the plastic and then compressing and adhering this notched portion into a sheetstock of paper. The plastic would then be die-cut to the card shape desired. The card portion could also have a hole through it to make it acceptable as a tag (not shown).

Return Envelope Mailers

An additional way to make return envelope mailers compared to the previous application is to take a sheet of compressible paper, fold a portion of it to the return envelope size desired, adhere two sides of the folded portion to form a pouch and then compress the pouch portion so that it is coplanar and functionally equivalent thickness to the remainder of the sheetstock. As before, additional window holes can be cut in the remainder of the sheetstock, both in the envelope portion and the base sheet, and paper or plastic patches can be secured to the holes by indenting the area around the holes and adhering a translucent material to create the windows and additional rewettable adhesives or transfer tapes can be added to facilitate sealing the pouch to form a return envelope.

Labels

An additional way to make a paper sheetstock with a removable pressure sensitive or rewettable label portion would be to take commercially available composites such as a combination liner, release material, adhesive, and imprintable paper or plastic label stock and compress it in the base sheetstock so that the thickness of the these materials and the sheetstock is the same thickness as the base sheetstock. The label portion could also have a hole through it to make it acceptable as a tag (not shown). The top label portion could also have a carbonless microencapsulated coating on it to facilitate making duplicate copies on the liner below it when it is hit with pressure as with an impact printer.

PREPARATION OF THE SHEETSTOCK-FOR IDENTIFICATION CARDS

The plastic identification card construction shown in FIG. 1 through FIG. 3 may be made as follows. A web of paper 12 such as 110 pound Index paper being approximately 0.093 inches (0.23 cm) thick is unwound from a roll of paper. A hole 20 is cut through the web and removed slightly larger than the size of the identification card 20 desired. A paper or plastic laminate 14 is unwound from a roll and has adhesive 16 added to it to secure it to the paper base sheetstock. Adhesive 18 could possibly be the same as adhesive 16 or a different adhesive which would need to be such that it allows for the release of plastic card 20. In addition, a combination of release layers and adhesive could be used. An additional plastic laminate 20 is unwound and laid on top of the holes that have been cut with the patch and adhesive. The plastic laminate 20 is then cut to the shape desired and the waste matrix is removed so that the identification card is in the position desired. The web may then be run through crushing rollers to make the sheetstock coplanar and have functionally equivalent thicknesses. The web is then sheeted to the size desired. The plastic identification card could also be preprinted and cut to size and affixed into place using tipping on equipment as is common in the trade.

The constructions of FIGS. 4 through 6 may be made similar to above, only the patch material 36 would have an additional hole cut in it slightly smaller than the plastic identification card to be affixed and the hole's waste removed. Adhesive is added to the edge of the hole so that the card can be affixed to the edge of the card in an over-lapping fashion.

The construction of FIGS. 7 through 9 may be made by routing with machines designed to remove portions of the plastic laminate 64 which could be a 700 gauge heat stabilized polyester Melinex ST 505 from ICI Films of Delaware so that it is notched on one edge. This notched plastic edge then has adhesive 66 added to the notched portion similar to methods previously described. This notched portion is then crushed into the paper 62 which could be a 7 pt. Augusta Bristol from Federal Paper using methods previously described so that paper 62 is coplanar and functionally equivalent in thickness to 64. The die cuts 70 are then cut through the plastic 64 so that the card can be punched out when pressure is exerted.

The constructions of FIGS. 10 through 12 may be made by using a twin web laminating system.

The constructions of FIGS. 13 through 15 may be made by taking a single sheet of compressible paper 104 and adding a cross-web adhesive pattern as is common in the trade that is allows adhesive 106 to be applied to the edges in the area to be formed as a pocket or return envelope. A rewettable adhesive 118 or transfer tape is also added to the sheet. A hole 108 is cut through the paper and optionally additional holes such as 114. Adhesive 112 is added to the sheet and a plastic or glassine patch 110 is affixed on top of the adhesive 112. The patch is then crushed into the paper with a knobbed crushing roller. The paper is then plow-folded, as is common in the trade, and the pocket is formed. The pocket area is the crushed to create a coplanar and functionally equivalent sheet. The form is then sheeted to the size desired.

Figure 17:
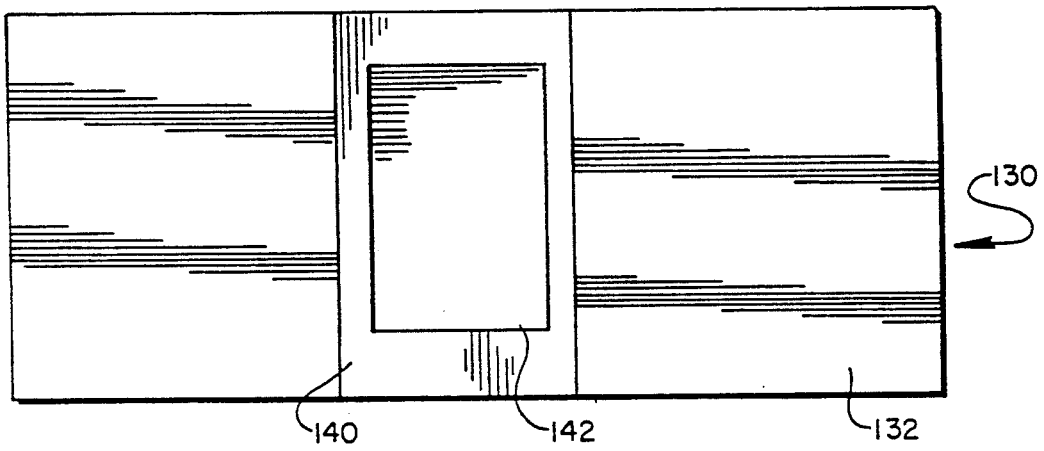
FIG. 17 is a top view of the label sheet of FIG. 16.
Figure 18:
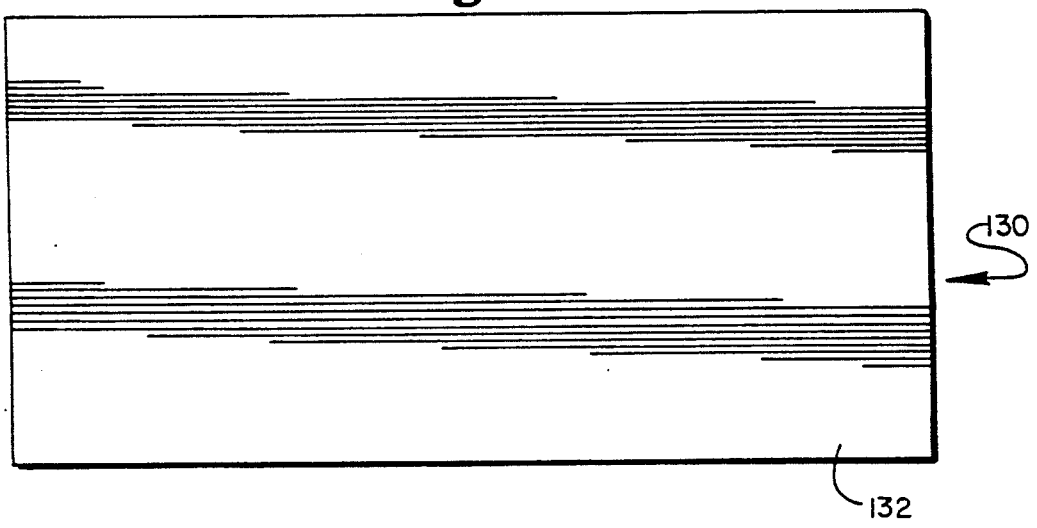
FIG. 18 is a bottom view of the sheet of FIGS. 16 and 17.

The constructions of FIGS. 16 through 18 is formed by taking a commercially available release liner 136, release coating 138, adhesive 140, and label stock 143, and adding adhesive 134 to the bottom of the liner as with adhesive application methods previously described, affixing it to the paper web 132, and then crushing it into the paper stock 132 with crushing rollers as described previously.

While this invention may be embodied in many different forms, there are shown in the drawings and described in detail herein specific preferred embodiments of the invention. The present disclosure is an exemplification of the principals of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. Sheetstock comprising:

a) a first sheet having at least one opening therethrough;

b) a second sheet having a lesser surface area than and being adhered to said first sheet covering each of said at least one opening, said second sheet being constructed and arranged to present a coplanar surface to the surface of said first sheet to which it is adhered; and c) at least one identification card positioned in said opening and temporarily adhered to said second sheet.

2. The sheetstock of claim 1 wherein said second sheet has at least one opening therethrough such that print may be applied to a portion of said identification cards which are accessible through said opening.

3. The sheetstock of claim 1 wherein said identification card presents a substantially coplanar surface with said first sheet such that said sheetstock has functionally equivalent thickness in substantially all portions thereof.

4. Sheetstock for preparing a return envelope mailer capable of being printed with a printing process, comprising:

a) a base sheet of paper having an upper and lower surface;

b) a portion of said base sheet being folded back upon itself and compressed to decrease the thickness of said folded back portion such that the folded back paper combined thickness is substantially equal to the remainder of the base sheet, such that the entire sheet is substantially coplanar;

c) said portion of said base sheet including adhesion lines to adhere edges of said folded back base sheet together thereby defining a pocket;

d) said sheetstock having functionally equivalent thickness in substantially all portions thereof.

5. The sheetstock of claim 4 wherein said base sheet includes means for separating said pocket from said base sheet.

6. Sheetstock comprising:

a) a first sheet having a top and a bottom;

b) a second sheet having an upper and lower surface, said second sheet having a lesser surface area than and overlapping and adhered over an edge of said first sheet bottom, said second sheet lower surface and first sheet bottom being constructed and arranged to present a coplanar outer surface; and c) at least one identification card positioned on said second sheet upper surface and temporarily adhered to said second sheet, said sheetstock having functionally equivalent thickness in substantially all portions thereof.

7. A sheetstock which presents an adhesive-backed label, the sheetstock comprising:

a) a first sheet;

b) label stock having a lesser surface area than and being adhered with a pressure sensitive adhesive to a release liner; and c) said release liner being positioned between said label stock and said first sheet, said release liner being adhered to said first sheet, said sheetstock being constructed and arranged to have functionally equivalent thickness with the release liner and label stock being impressed into said first sheet.

8. The sheetstock of claim 7 further including cuts through said label stock to define at least one label that may be removed leaving a remnant of label stock behind.

* * * * *